US005829287A

United States Patent [19]

Noé et al.

[11] Patent Number: 5,829,287

[45] **Date of Patent: *Nov. 3, 1998**

[54] METHOD FOR CONTINUOUSLY LEVELING THIN METAL

[75] Inventors: Oskar Noé ; Andreas Noé ; Rolf Noé , all of Mülheim, Germany

[73] Assignee: BWG Bergwerk- und Walzwerkmaschinenbau GmbH, Duisburg, Germany

[ * ] Notice: The term of this patent shall not extend beyond the expiration date of Pat. No. 5,704,237.

[21] Appl. No.: 842,477

[22] Filed: Apr. 23, 1997

Related U.S. Application Data

[62] Division of Ser. No. 615,699, Mar. 13, 1996, Pat. No. 5,704,237.

[30] Foreign Application Priority Data

Mar. 14, 1995 [DE] Germany ..... 195 09 067.5

[51] Int. Cl.[6] ..... B21D 1/05

[52] U.S. Cl. ..... 72/8.6; 72/161; 72/164; 72/205

[58] Field of Search ..... 72/161, 164, 165, 72/205, 11.1, 11.6–11.8, 12.7, 12.8, 8.6, 8.9, 9.4

[56] References Cited

U.S. PATENT DOCUMENTS

| | | | |
|---|---|---|---|
| 3,328,992 | 7/1967 | Stone | 72/205 |
| 3,459,019 | 8/1969 | Stone | 72/205 |
| 5,341,664 | 8/1994 | Noe | 72/161 |

FOREIGN PATENT DOCUMENTS

| | | | |
|---|---|---|---|
| 2 203 911 | 8/1973 | Germany . | |
| 39 12 676 | 12/1992 | Germany . | |
| 42 30 243 | 1/1994 | Germany . | |
| 43 23 385 | 1/1995 | Germany . | |
| 193230 | 11/1982 | Japan | 72/164 |
| 185524 | 10/1984 | Japan | 72/164 |
| 37323 | 2/1986 | Japan | 72/205 |
| 33015 | 2/1987 | Japan | 72/164 |
| 15226 | 1/1989 | Japan | 72/205 |

*Primary Examiner*—Daniel C. Crane
*Attorney, Agent, or Firm*—Herbert Dubno

[57] ABSTRACT

The stretch leveling or stretch-bend leveling of aluminum or stainless steel strip of a thickness of 0.1 to 0.5 mm is carried out following a measurement of strip nonplanarity or strip profile by regulating the stretch in the stretch leveler or the contour of a roller thereof or both and/or by regulating the depth of penetration or degree of bending by the stretch-bend rollers. The tension in the strip just before coiling is varied in response to measurement of the thickness of the strip across the width, thereby optimizing the leveling and surface qualities of the strip.

4 Claims, 1 Drawing Sheet

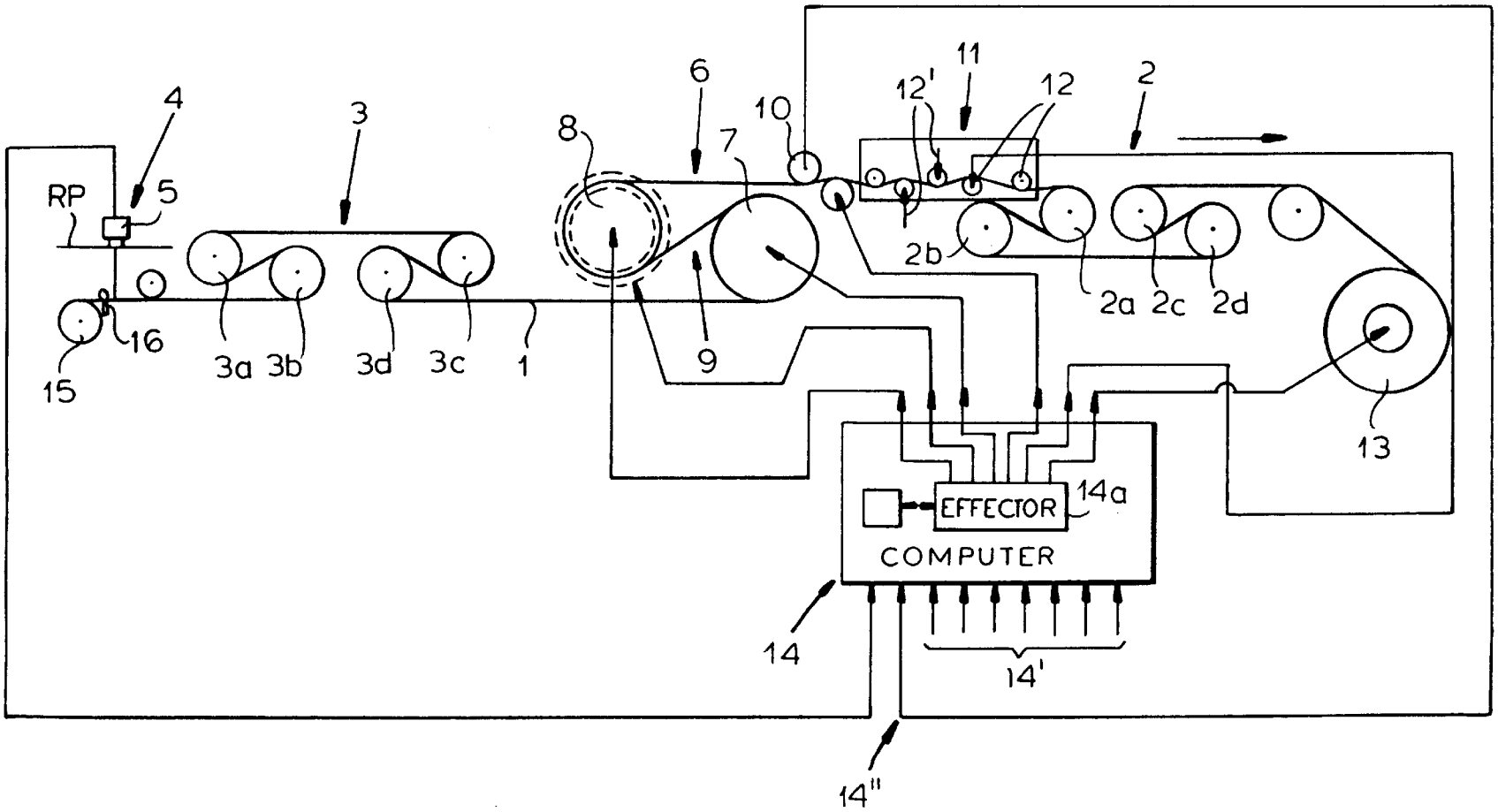
13
2d
2c
2a
2
12
11
12'
2b
14a
EFFECTOR
COMPUTER
14'
14''
14
10
7
6
9
8
1
3c
3d
3
3b
3a
4
5
16
RP
15

METHOD FOR CONTINUOUSLY LEVELING THIN METAL

CROSS REFERENCE TO RELATED APPLICATION

This application is a division of Ser. No. 08/615,699 filed 13 Mar., 1996, now U.S. Pat. No. 5,704,237 issued 6 Jan., 1998.

FIELD OF THE INVENTION

Our present invention relates to a method of continuously leveling thin metal strip and especially aluminum and stainless steel strip with a strip thickness of 0.1 mm to 0.5 mm. Our invention also relates to an apparatus for carrying out this method.

BACKGROUND OF THE INVENTION

Thin metal strip, for example, lithographic sheets or bands of aluminum or bright annealed stainless steel strip must be manufactured under present day standards with increasingly greater requirements with respect to strip planarity and the highest quality of the strip surfaces. All methods of leveling such strip include either tension leveling or stretch-blend leveling and efforts have been made with these systems to bring about the high qualitative requirements mentioned previously. For example, tension or stretch leveling can be carried out in stages with an intervening stretching roll pair in DE 39 12 676 or with the use of concave/convex tension-producing rolls (German Patent document 42 30 243) or with coil/set control (German Patent document 43 23 285). With these leveling processes the planarity can increasingly approach 1I unit. 1I unit corresponds to a measurement precision of 10 $\mu$m/m for the length difference in metal strip.

However, in the leveling of thin metal strip a particular problem arises in that planarity cannot be measured continuously on line after leveling since the metal strip in the process line itself has the appearance of optical planarity because of the strip tension thereon.

Measurement devices which measure the tension distribution across the width of the strip and from that are able to allow calculation of planarity, i.e. so-called shapemeter rolls, cannot be used in these cases since the measurement precision does not reach levels of ±2 to 5 I units so that residual corrugations of under 1 I unit cannot be detected. Furthermore, from a leveled coil, samples must be cut away and measured for planarity on a planarity measurement table to yield results of the order of 0.1-I unit. Strength variations in metal strip cannot be detected and can give rise to fluctuations in the leveling results. Thickness fluctuations as a rule lie below 2% and have less of an affect on the leveling results. As a consequence, the two remaining effects, namely, the lack of planarity prior to leveling and the strip cross section or profile, can remain problems. It is to overcome these drawbacks that the invention has been developed.

OBJECTS OF THE INVENTION

It is, therefore the principal object of the present invention to provide an improved process for the leveling of thin metal strip, especially aluminum strip and stainless steel strip having strip thickness of 0.1 mm to 0.5 mm in an on-line and continuous manner free from drawbacks of earlier systems.

Another object of the invention is to provide an improved apparatus for carrying out the method of the invention.

Still another object is to provide a method of leveling thin metal strip of the particular kinds mentioned above which can yield surface qualities and planarity of greatly enhanced degrees.

SUMMARY OF THE INVENTION

These objects and others are attained, in accordance with the invention, in a process for the continuous leveling of thin metal strip, especially aluminum and stainless steel strip with thickness of 0.1 mm to 0.5 mm in a strip processing line and wherein the strip planarity or deviations from planarity and/or the strip profile or cross-sectional shape can be measured prior to leveling and, in dependence upon the measured value, in the course of a stretch leveling the degree of stretch is controlled and a correction roller has its inward or outward bulging continuously modified to achieve and optimize the degree of stretch. In other words based upon the measurement the stretch leveling process is anticipatorily controlled to eliminate the unplanarity.

Alternatively, or in addition, in the course of a stretch-bend leveling, the stretch tension, the penetration depth of the stretch-bend rolls and the reverse bending of the strip on the stretch-bend rolls are adjusted to obtain an optimum value of the measured parameter. Here too, the value is obtained by an anticipatory control, i.e. a predictive regulation based upon the measurement.

The method of continuously leveling thin strip can thus comprise the steps of:

(a) continuously feeding thin metal strip along a strip processing line to a leveling station;

(b) continuously measuring at least one parameter of the thin metal strip selected from unplanarity of the strip and the strip profile upstream of the leveling station;

(c) subjecting the strip to stretch leveling at the leveling station in part by passing the strip over at least one roll having a variable curvature over a length thereof; and (d) continuously varying the curvature by changing the radius of curvature of the roll in response to the measurement of the parameter and in anticipation of the result of the variation on the parameter to maintain an optimum setting of the parameter.

Alternatively, the method can comprise the method defined above wherein the strip is an aluminum or stainless steel strip with a strip thickness of 0.1 mm to 0.5 mm.

In yet another method in accordance with the invention, the thin metal strip in the strip processing line is continuously leveled by:

(a) continuously feeding thin metal strip along a strip processing line to a leveling station formed by a region of the line at which the strip is under tension immediately before coiling of the strip;

(b) continuously measuring at least one parameter of the thin metal strip selected from unplanarity of the strip and the strip profile upstream of the leveling station;

(c) subjecting the strip to leveling at the leveling station under the tension; and (d) continuously varying the tension in response to the measurement of the parameter and in anticipation of the result of the variation on the parameter to maintain an optimum setting of the parameter.

In its apparatus aspects, the apparatus can comprise:

an upstream bridle traversed by a continuous thin metal strip and exerting a braking force thereon;

a downstream bridle spaced from the upstream bridle and advancing the strip to apply tension to the strip;

a coiler downstream of the downstream bridle for receiving the strip and winding the strip up in a coil;

a stretch-bend leveler between the upstream bridle and the downstream bridle and having rolls engaging the strips from opposite sides and penetrating to respective depths into a planar path of the strip, the rolls having respective sags;

a correcting roll around which the strip extends between the upstream bridle and the downstream bridle and having a variable curvature over a length thereof;

a measuring station upstream of the upstream bridle for measuring at least one parameter of the thin metal strip selected from unplanarity of the strip and the strip profile; and control means connected to the measuring station for maintaining an optimum setting of the parameter by continuously varying selectively:

at least one of a plurality of characteristics of the stretch-bend leveler selected from the tension of the strip in the stretch-bend leveler, the depths and the sags, the curvature by changing the radius of curvature of the roll, and varying the tension of the strip immediately upstream of the coiler in response to the measurement of the parameter.

The invention is based upon our discovery that the leveling results can be treated in terms of parameters like the unplanarity of the strip and the strip profile prior to leveling and can be controlled based upon these parameters to achieve leveling results which satisfy even the most stringent modern requirements especially for aluminum or stainless strip with a strip thickness of 0.1 to 0.5 mm. When these parameters are determined in a measuring process prior to the leveling operation, the leveling process whether it is stretch leveling only, or a combination of the two, can be varied with respect to strip tension, degree of stretching, concave inward bulging or convex outward bulging of a correction roll, penetration depth and degree bending of stretch-bend rolls. These latter can be controlled to optimize the leveling operation.

For the purposes of this invention, stretch leveling will be considered leveling accomplished by applying such tension to the strip, without reverse bending thereof, that there is an actual elongation of the strip between the points at which the stretching tension is applied, whether the tension is applied between two clamps or between two sets of bridle rolls or in any other way. In stretch-bend leveling, the strip is bent alternatively to one side or another along sets of rails engaging strip from opposite sides, the rolls of one set being located between the rolls of another so that the strip is bent alternately form one side to the other. In that case, the degree of penetration is a measure of the degree to which the rolls of the stretch-bend leveler project beyond a median plane between the two sets of rollers, usually a horizontal plane. The roller sag which can be controlled as well in the case of the stretch-bend leveler, is another controllable parameter of the stretch-bend leveler.

It is advantageous to minimize the degree of stretch, however, in both leveling processes so as to reduce to a minimum the changes in the properties of the metal strip so that the leveling results are as reproducible as possible.

It is possible, according to the invention, to reduce the degree of stretch of a metal strip having edge corrugations to a minimum by operating with a correction roller which has the desired degree of convexity.

Depending upon the height of the edge corrugations, the traction or correction rollers can be adjusted to be increasingly convex and thereby increase the degree of stretch locally to eliminate the edge corrugations using as a basis the measurement of unplanarity of the strip so that from the center to the originally corrugated edge, the corrugations are eliminated. When necessary or desirable with a concave set of the tension or correction rollers, the degree of stretch can be reduced to achieve a similar leveling result. In this case, the tension or correcting rolls in the region of the center of the strip can be made concave so that edge corrugations can be eliminated.

In either case, the nonplanarity is measured upstream of the leveling stretch and the leveling parameters are then adjusted (degree of stretch and contour of the tension or corrector rolls in the case of stretch leveling and strip tension, degree of stretch, depth of roll penetration and sag in the case of stretch-bend leveling) in a continuous forward control or anticipatory operation to eliminate the nonplanarity and nonuniform profile.

Indeed, for different metal strips optimum leveling values can be developed in a trial run, i.e. off-line, with off-line measurement and these values can then be stored and conveyed to the controller of the strip-processing line when the same type of strip is processed along this line. In that case, the leveling unit is automatically set to the desired values based upon the stored values which are then used to control the operation of the leveler.

For example, aluminum coils of strip which are usually dished at the outer diameter and are characterized by edge corrugations at the inner diameter can be optimally leveled over the entire coil length.

The second parameter which is measured, namely the strip profile, can be measured on line by, for example, a thickness-measurement head traversed back and forth across the web width, can be provided in an input for setting of the leveling unit which can then optimize the strip profile downstream of the leveling unit. In practice, however, control using the strip profile has not been found to be as effective as control using strip unplanarity. It is however important to adjust the strip tension on the coiler as a function of strip profile.

For example, a strip profile with a thickness increase in the region of the strip center resulting from leveling, can result in a coil having compression stresses with a tendency of creep to yield central dishing. This can have a negative effect on the planarity after leveling and should be avoided as much as possible. The invention thus also provides a process for the continuous leveling of thin metal strip as mentioned previously, especially aluminum and stainless steel strip of a thickness of 0.1 to 0.5 mm in the strip line in which the strip profile is measured prior to leveling and as a function of the measured value, the strip tension directly before coiling of the strip is regulated to an optimum value.

The measuring device for the strip profile or nonplanarity can be a device which measures the distance of a surface of the strip from a reference plane and can be a shape-meter rail or a laser beam measuring device whose laser beams are directed perpendicular to the continuously-moving metal strip and are projected against the metal strip across the strip width, either with a multiplicity of laser beams or by sweeping the laser beam across the strip width. The measuring station should be located in a region in which the strip is under a minimal strip tension and thus upstream of the bridle roll pair which can engage the strip at the upstream side of the tension application zone. Low strip tension is intended to mean a region in which the strip tension is less than $15N/mm^2$ for stainless steel strip.

The strip measuring unit can be connected to a control system regulating the leveler.

BRIEF DESCRIPTION OF THE DRAWING

The above and other objects, features, and advantages will become more readily apparent from the following description, reference being made to the sole Figure of which the side view is a portion of a strip-processing line for carrying out the method of the invention.

SPECIFIC DESCRIPTION

In the sole Figure of the drawing, we have shown an apparatus for the leveling of aluminum or stainless steel strip which comprises, at its upstream end, an uncoiler 15 representing the beginning of the press line, a brake 16 which can represent the remaining portions of the process line and, as shown in the drawing, the stages which apply tension to the strip 1 and thus form the portion of the process line with which the invention is concerned.

The aluminum or stainless steel strip has a thickness of 0.1 mm to 0.5 mm.

The stretch-bend leveling portion of the line can comprise a downstream set of bridles 2, the latter including pairs of bridle rolls 2*a*, 2*b* and 2*c*, 2*d* which are driven at a speed greater than the peripheral speed of the upstream bridle roll set to maintain a continuous tension of the strip 1 in the region between the bridle roll sets.

The bridle roll set 3 comprises an upstream pair of bridle rolls 3*a*, 3*b* and a downstream pair of bridle rolls 3*c*, 3*c* driven at a peripheral speed which can be less than that of the downstream bridle roll set.

Upstream of the bridle roll set 3 which forms the beginning of the high tension zone, is a measuring station 4 with a measuring device which measures the distance between the upper surface of the strip 1 and a reference plane RP perpendicular to the strip and over the width of the strip. The measurement provides an input for the control computer 14 which will be discussed further below. The input is a measurement of the strip profile, i.e. the changes in thickness across the width of the strip, or of strip nonplanarity.

Between the upstream bridle roll set 3 and the downstream bridle roll set 2, is a tension-leveling region 6 and a stretch-bend leveling region formed by a stretch-bend leveler 11 in series. The tension-leveling section 6 comprises a brake roll 7 about which the strip 1 initially passes and which is looped by the strip 1 through more than 180°. The strip then passes over a tension roller 8 so that between the rollers 7 and 8, a region 9 is provided in which the strip is stretched, i.e. elongated, by the difference in peripheral speeds of the rolls 7 and 8.

A tension-measuring roll system is provided at 10. Downstream of the tension-measuring roll system, which can be controlled, is the stretch-bend leveler 11 itself. The latter has stretch-bend rolls 12 whose depth of penetration as represented by the arrows 12' can be controlled too as has been described. In addition, the degree of bending around the rolls 12 can be regulated if desired.

Downstream of the downstream bridle set, we show a coiler 13 whose speed can be adjusted to regulate the tension in the strip on coiling.

The control unit 14, which includes a computer, can have inputs as represented at 14' for programming or for the setting parameters for the strip line and inputs as represented at 14" for the measurement of the strip profile for unplanarity. The computer 14 can have an effector output represented at 14*a* for controlling the speeds of the rolls 7 and 8, the bulging of the roll 8, the tension at 10 upstream of the stretch-bend leveler 11 and the depth of penetration of the stretch-bend rollers in this leveler as well as the tension applied via the coiler 13 to the strip just prior to coiling.

As a consequence, the strip nonplanarity is continuously measured and the measurement result fed to the computer 14 so that optimum leveling can be accomplished by either controlling stretching at 9 between the rolls 7 and 8 or the bulging inwardly or downwardly of the tension roll 8 or both or the depth of penetration or degree of bending in the stretch bend leveler or both. A continuous on-line elimination of strip defects is thus ensured in the manner described. The apparatus also allows optimum setting of the strip tension upstream of the coiler 13 in response to the strip thickness measurement at station 4.

We claim:

1. A method of continuously leveling thin metal strip in a strip processing line, comprising the steps of:

(a) continuously feeding thin metal strip along a strip processing line to a leveling station;

(b) continuously measuring at least one parameter of the thin metal strip selected from unplanarity of the strip and the strip profile upstream of the leveling station by measurement of a distance from the strip in a direction perpendicular to the strip;

(c) subjecting the strip to stretch leveling at said leveling station in part by passing said strip around a braking roll and then around at least one roll having a variable curvature over a length thereof variable from a convex curvature to a concave curvature; and (d) comprising a measurement made in step (b) with stored values for different metal strips and selecting a correction value, and continuously varying said curvature by changing the radius of curvature of said roll in accordance with said correction value to anticipate potential changes in and maintain an optimum setting of said parameter.

2. The method defined in claim 1 wherein said strip is an aluminum or stainless steel strip with a strip thickness of 0.1 mm to 0.5 mm.

3. The method defined in claim 2 wherein said parameter is measured by directing a multiplicity of laser beams spaced across a width of the strip at the strip from a reference location, and measuring a distance from said location to the strip.

4. The method defined in claim 1, further comprising the step of continuously controlling the stretch imparted to said strip during stretch leveling in step (c) in response to said parameter.

* * * * *